US010566738B2

(12) United States Patent
Hung et al.

(10) Patent No.: US 10,566,738 B2
(45) Date of Patent: Feb. 18, 2020

(54) ELECTRICAL CONNECTOR HAVING A LOCKING MECHANISM

(71) Applicant: ALLTOP ELECTRONICS (SUZHOU) LTD., Suzhou, Jiangsu Province (CN)

(72) Inventors: Yung-Chih Hung, New Taipei (TW); Wang-I Yu, New Taipei (TW)

(73) Assignee: ALLTOP ELECTRONICS (SUZHOU) LTD., Suzhou, Jiangsu Province (CN)

( * ) Notice: Subject to any disclaimer, the term of this patent is extended or adjusted under 35 U.S.C. 154(b) by 0 days.

(21) Appl. No.: 16/422,871

(22) Filed: May 24, 2019

(65) Prior Publication Data

US 2019/0363490 A1 Nov. 28, 2019

(30) Foreign Application Priority Data

May 24, 2018 (CN) ..... 2018 1 0508515

(51) Int. Cl.
*H01R 13/62* (2006.01)
*H01R 13/639* (2006.01)
*H01R 13/629* (2006.01)

(52) U.S. Cl.
CPC ..... *H01R 13/639* (2013.01); *H01R 13/62955* (2013.01)

(58) Field of Classification Search
CPC ..... H01R 13/639; H01R 13/62933; H01R 13/62938; H01R 13/6295; H01R 13/62955
USPC ..... 439/345, 372, 157
See application file for complete search history.

(56) References Cited

U.S. PATENT DOCUMENTS

| | | | | |
|---|---|---|---|---|
| 9,831,602 | B1 * | 11/2017 | Kanda | H01R 13/62977 |
| 10,218,124 | B1 * | 2/2019 | Probert | H01R 13/62955 |
| 10,270,207 | B1 * | 4/2019 | Probert | H01R 13/502 |
| 10,290,973 | B1 * | 5/2019 | Gisoldi | H01R 13/62944 |
| 2011/0086533 | A1 * | 4/2011 | Kobayashi | H01R 13/62938 439/345 |

* cited by examiner

*Primary Examiner* — Khiem M Nguyen
(74) *Attorney, Agent, or Firm* — Cheng-Ju Chiang

(57) ABSTRACT

An electrical connector includes an insulative housing, a plurality of contacts, a plurality of wires and a locking mechanism. The insulative housing has a first side and a second side. The locking mechanism comprises a rotating member and a fastener, the rotating member has a pair of opposite rotary arms rotatably connected to the insulative housing and an holding arm, and the fastener is arranged on an inner side of the holding arm, the rotating member has a first status and a second status which can be switched by rotation, while the rotating member in the first status, the electrical connector and the complementary connector can be freely plugged in or separated from each other, and while the rotating member being rotated to near or in the second status, the fastener rotates or shifts to achieve a locking of the electrical connector and the complementary connector.

20 Claims, 16 Drawing Sheets

ELECTRICAL CONNECTOR HAVING A LOCKING MECHANISM

CROSS REFERENCE TO RELATED APPLICATIONS

The present application claims the priority of Chinese Patent Application No. 201810508515.0, filed on May 24, 2018, the content of which is incorporated herein by reference.

BACKGROUND OF THE INVENTION

1. Field of the Invention

The present invention relates to an electrical connector, and more particularly to an electrical connector locking with a complementary connector effectively.

2. Description of Related Art

As a traditional electrical connector mated with a complementary connector, the locking force therebetween is insufficient, and a poor electrical connecting may be caused easily. Especially in the high-voltage environment, a greater locking force is needed to prevent a poor connection caused by the loosening of the electrical connector and the complementary connectors.

Hence, it is desired to provide an electrical connector to overcome the problems mentioned above.

BRIEF SUMMARY OF THE INVENTION

Accordingly, an object of the present invention is to provide an electrical connector locking with a complementary connector effectively.

The present invention is directed to an electrical connector comprising an insulative housing, a plurality of contacts, a plurality of wires mechanically and electrically connected with the contacts and a locking mechanism for locking the electrical connector with a complementary connector. The insulative housing has a first side and a second side opposite to each other. The contacts are retained in the corresponding contact-receiving passageways of the insulative housing. The locking mechanism comprises a rotating member rotatably connected to the insulative housing and a fastener on an inner side of the rotating member, the rotating member has a pair of opposite rotary arms and an holding arm connected with the two rotary arms, the rotary arms are rotatably connected to the insulative housing, and the fastener is arranged on an inner side of the holding arm, the rotating member has a first status and a second status which can be switched by rotation, while the rotating member in the first status, the electrical connector and the complementary connector can be freely plugged in or separated from each other, and while the rotating member being rotated to near or in the second status, the fastener rotates or shifts to achieve a locking of the electrical connector and the complementary connector.

Other objects, advantages and novel features of the invention will become more apparent from the following detailed description of the present embodiment when taken in conjunction with the accompanying drawings.

DETAILED DESCRIPTION OF THE PREFERRED EMBODYMENT

Figure 1:
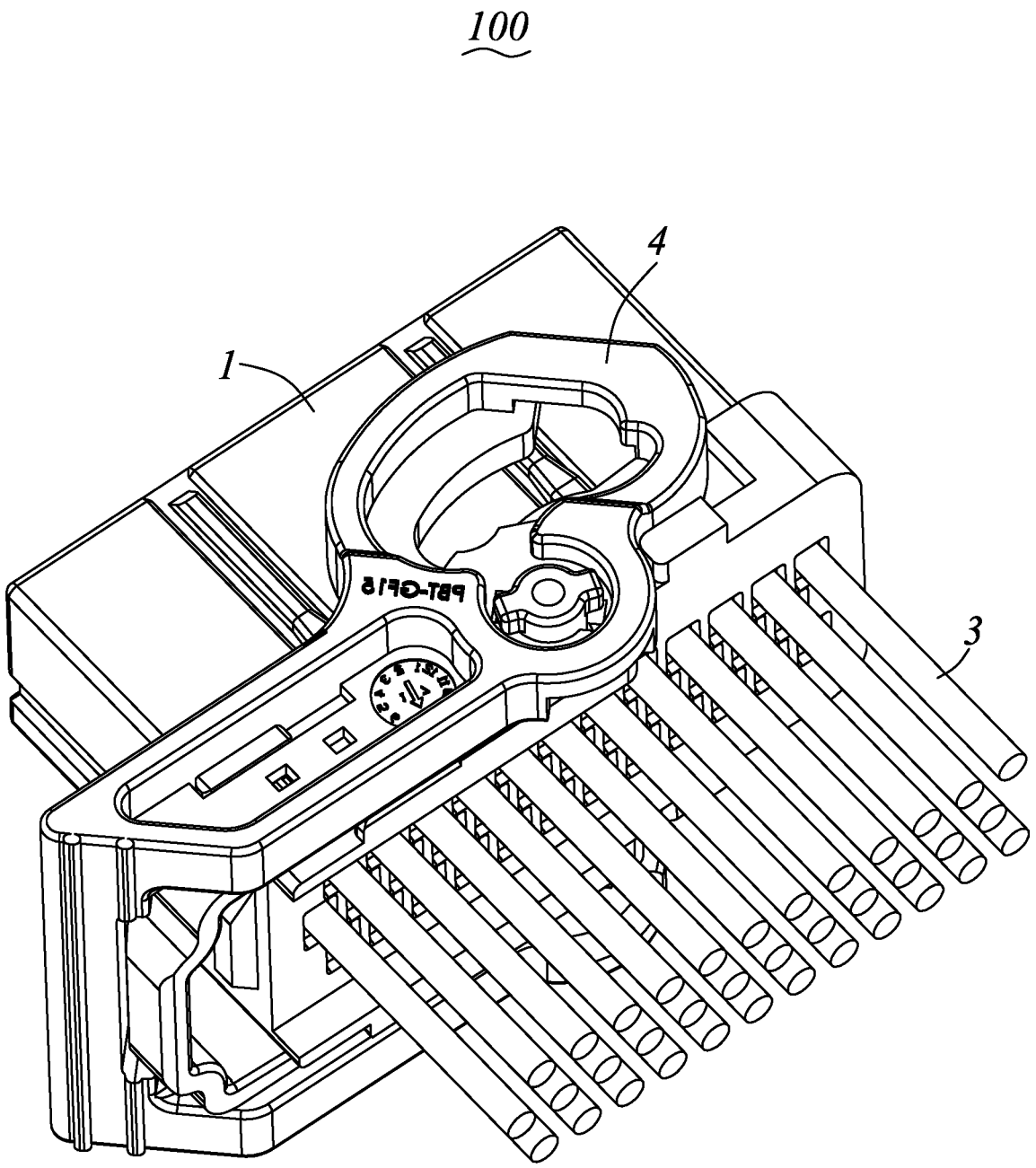
FIG. 1 is a perspective view of an electrical connector in accordance with a first embodiment of the present invention.

Reference will be made to the drawing figures to describe the present invention in detail, wherein depicted elements are not necessarily shown to scale and wherein like of similar elements are designated by same or similar reference numeral through the several views and same or similar terminology.

FIGS. 1-10 illustrate an electrical connector 100 according to a first embodiment of the present invention, and the electrical connector 100 comprises an insulative housing 1, a plurality of contacts 2 held in the insulative housing 1, a number of wires 3 electrically connected with the contacts 2 and a locking mechanism 4 for locking the electrical connector 100 with a complementary connector (not shown).

The insulative housing 1 has a first side and a second side opposite to each other, in the present embodiment, the first side and the second side are lateral sides of the insulative housing 1 in the height direction. The insulative housing 1 defines a plurality of contact-receiving passageways 11 between the first side and the second side, and each contact-receiving passageway 11 extends through the insulative housing 1 along a front-and-back direction, the contacts 2 are retained in the corresponding contact-receiving passageways 11 of the insulative housing 1.

The insulative housing 1 defines a pair of opposite pivots 12 on both sides along a height direction thereof and a protrusion 13 on one side along a transverse direction thereof.

The locking mechanism 4 comprises a rotating member 41 rotatably connected to the insulative housing 1 and a fastener 42 on an inner side of the rotating member 41. The rotating member 41 includes a pair of opposite rotary arms 411 and a holding arm 412 connected with the two rotary arms 411, the rotary arms 411 are rotatably connected to the insulative housing 1, and the fastener 42 is arranged on an inner side of the holding arm 412. The rotating member 41 has a first status and a second status which can be switched by rotation, while the rotating member 41 in the first status, the electrical connector 100 and the complementary connector can be freely plugged in or separated from each other. While the rotating member 41 being rotated to near or in the second status, the fastener 42 rotates or shifts to achieve a locking of the electrical connector 100 and the complementary connector.

After the electrical connector 100 mated with the complementary connector in the first status of the rotating member 41, the rotating member 41 is turned to the second status, the fastener 42 rotates or shifts under the pressure from the holding arm 412 or an external force, until it is locked with at least one of the insulative housing 1, the rotating member 41 and the complementary connector, therefore the rotating member 41 is locked in the second status to realize the electrical connector 100 locking with the complementary connector.

Figure 4:
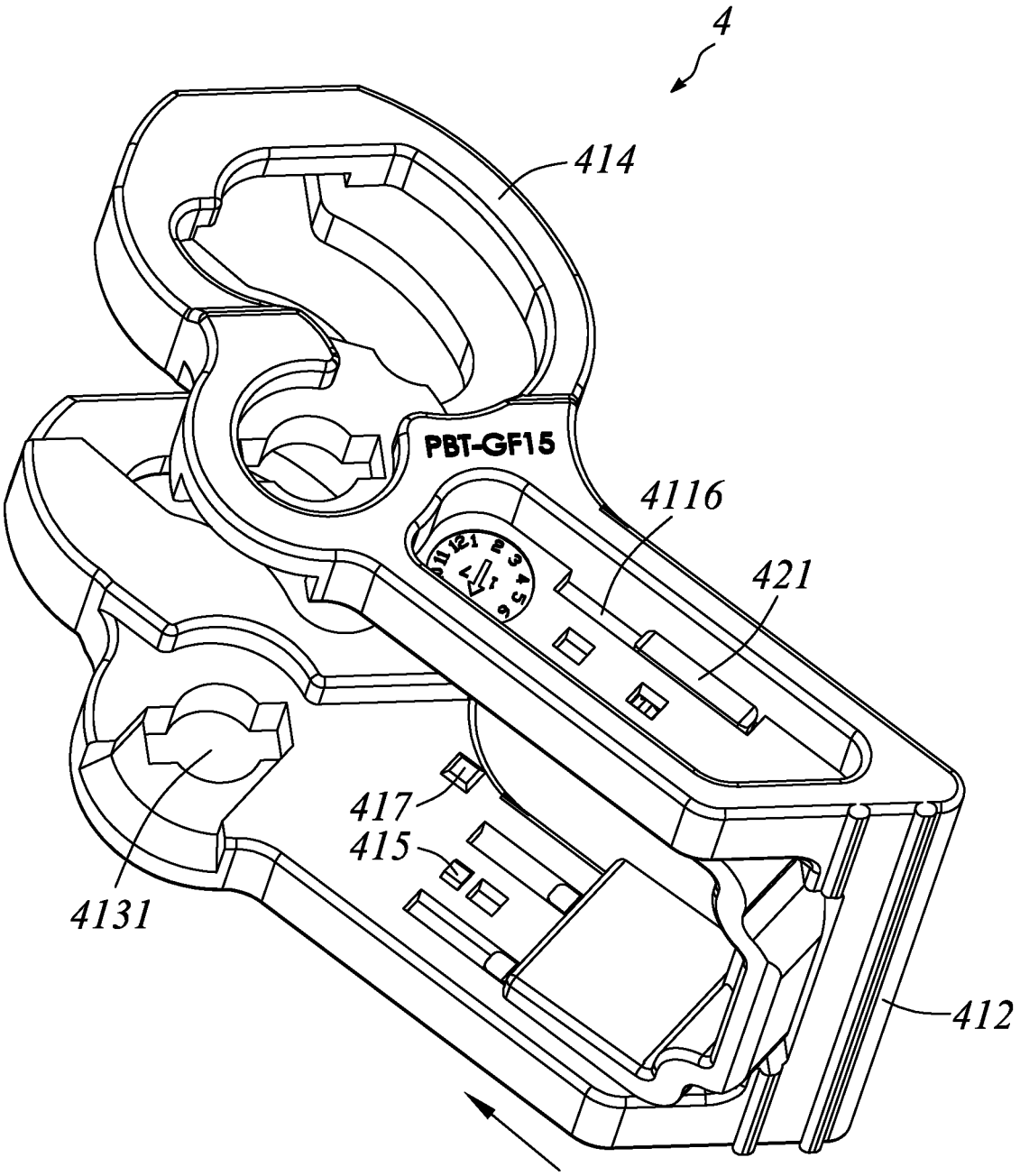
FIG. 4 is a perspective view of a locking mechanism of the electrical connector shown in FIG. 1.
Figure 5:
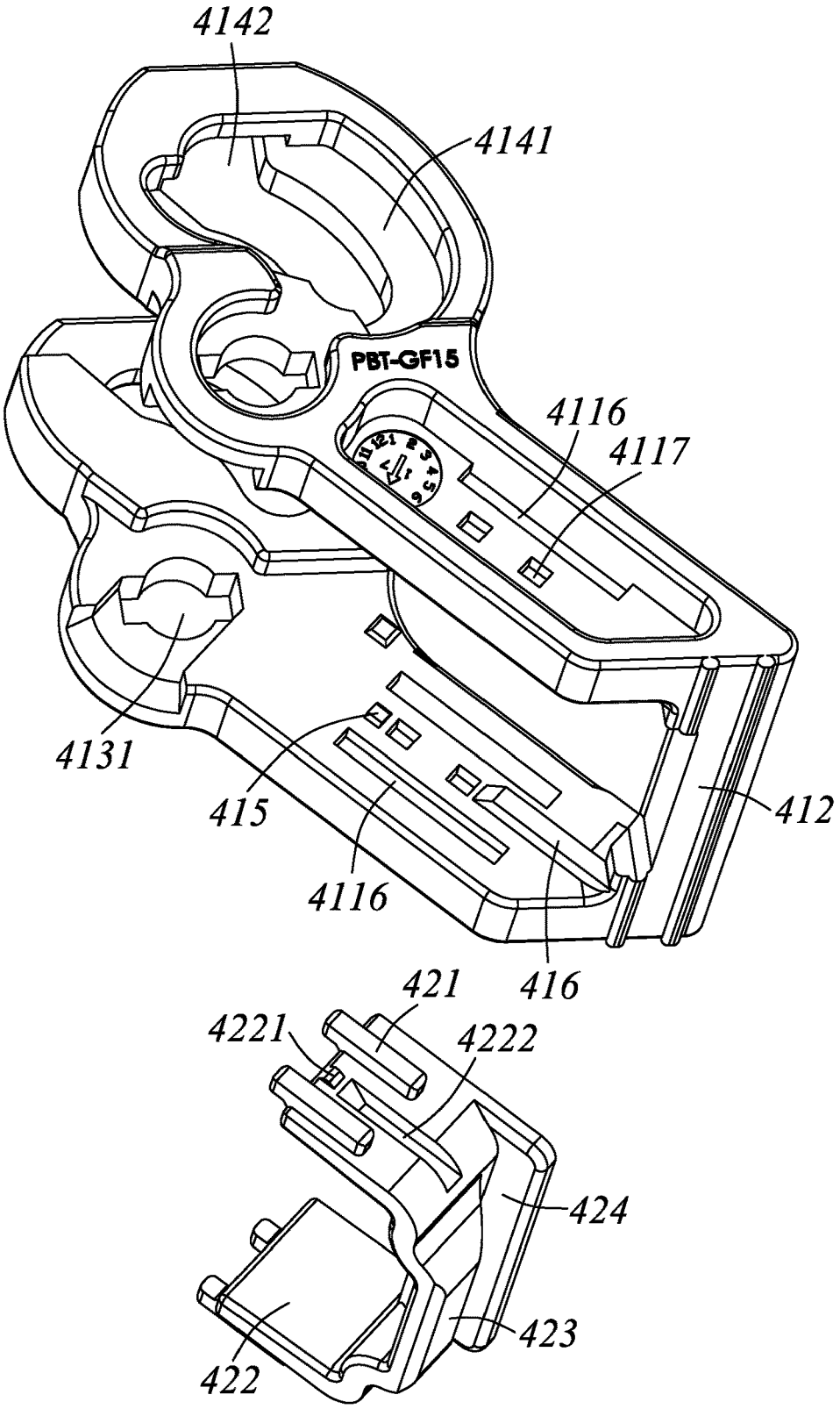
FIG. 5 is an exploded view of the locking mechanism shown in FIG. 4.
Figure 6:
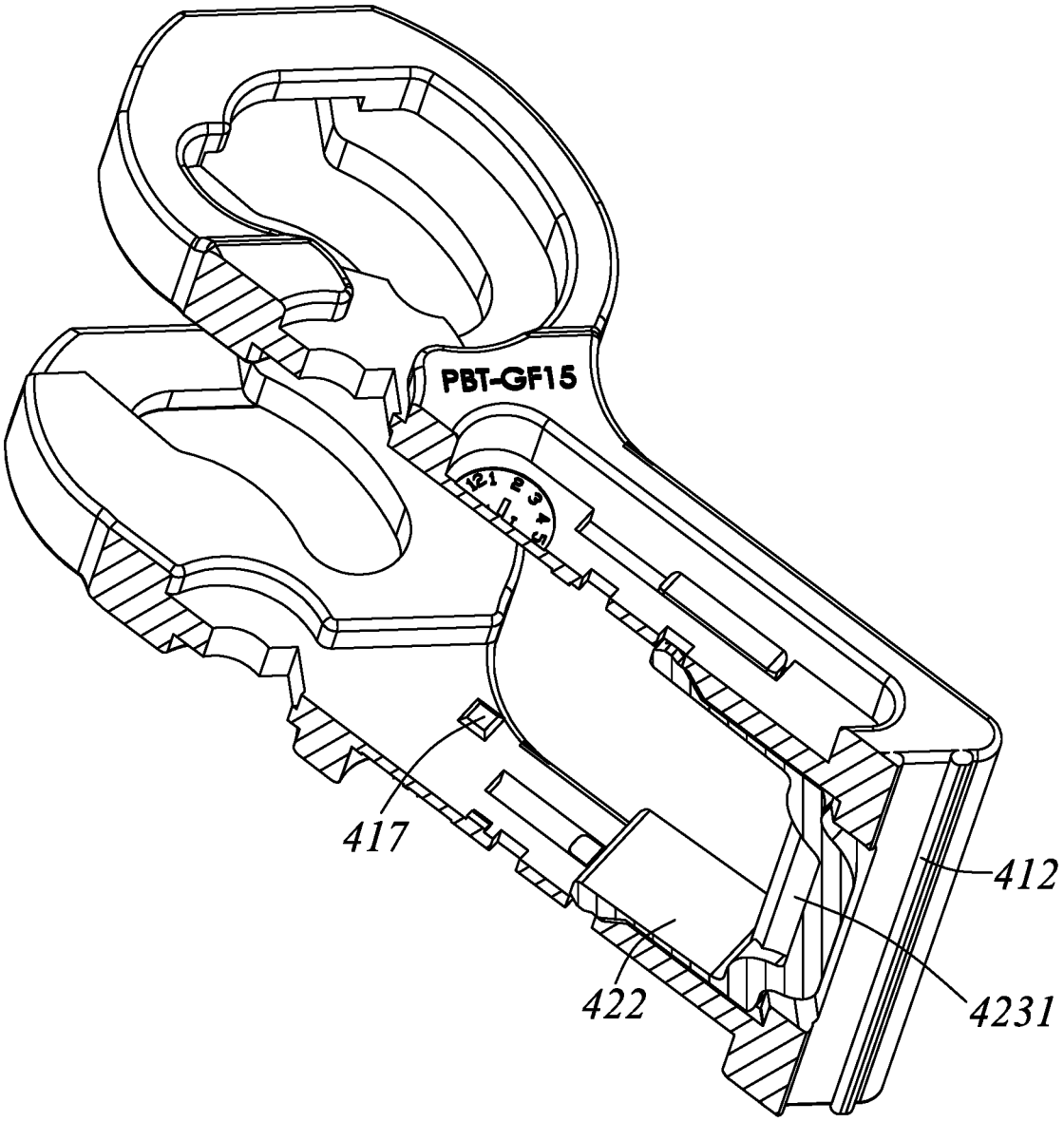
FIG. 6 is a cross-section view along line A-A in FIG. 4.
Figure 7:
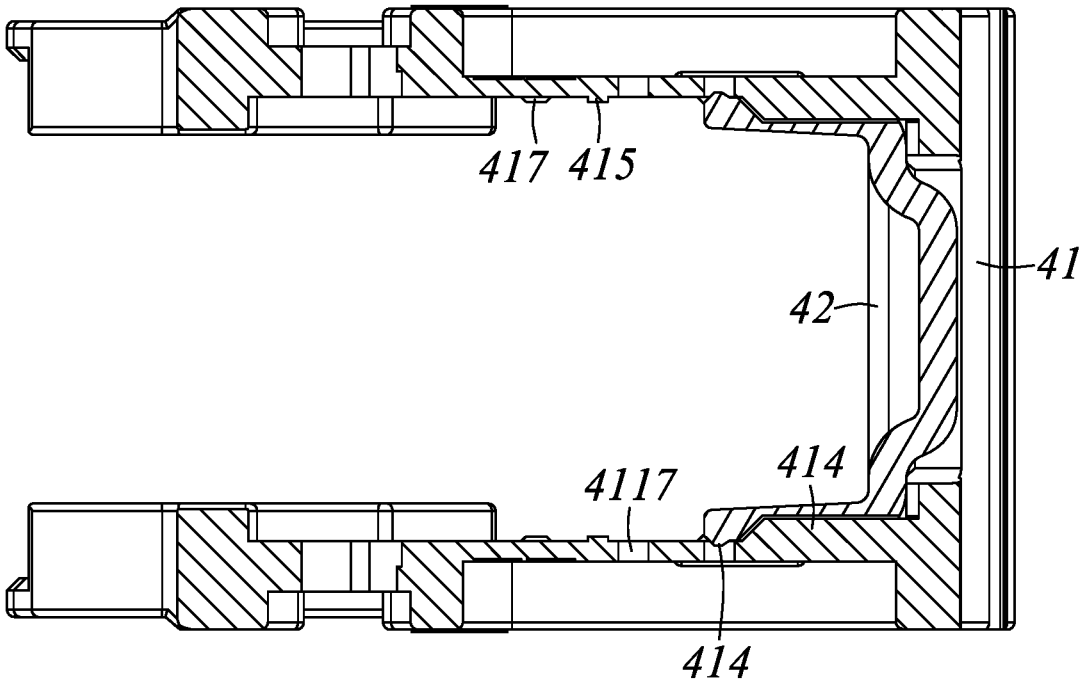
FIG. 7 is a sectional view of FIG. 4, and showing the locking mechanism located in a first position.
Figure 8:
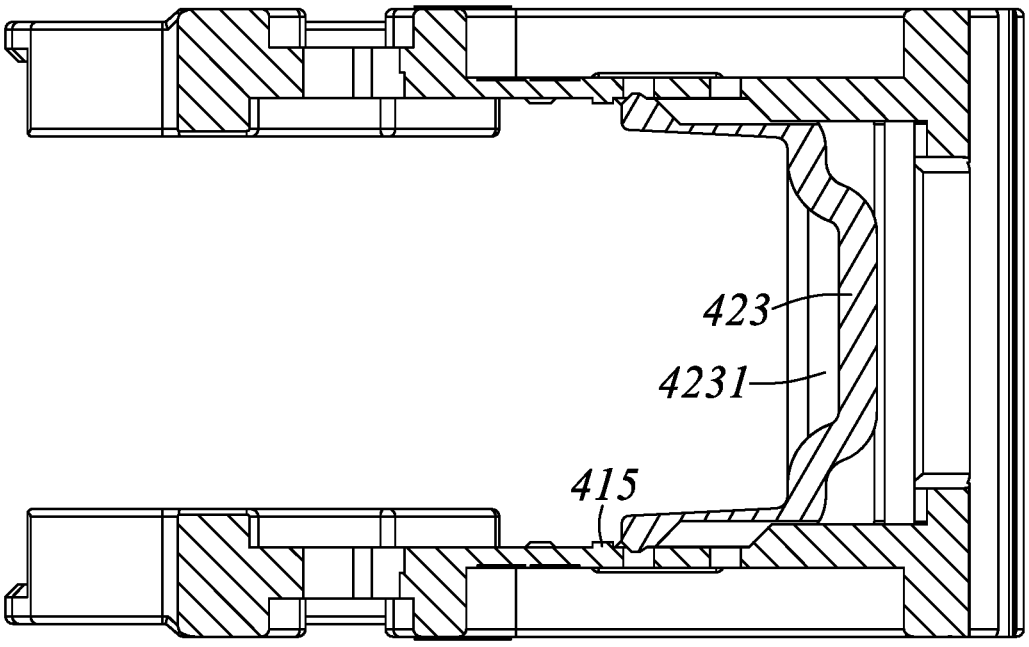
FIG. 8 is another sectional view of FIG. 4, and showing the locking mechanism located in a second position.
Figure 9:
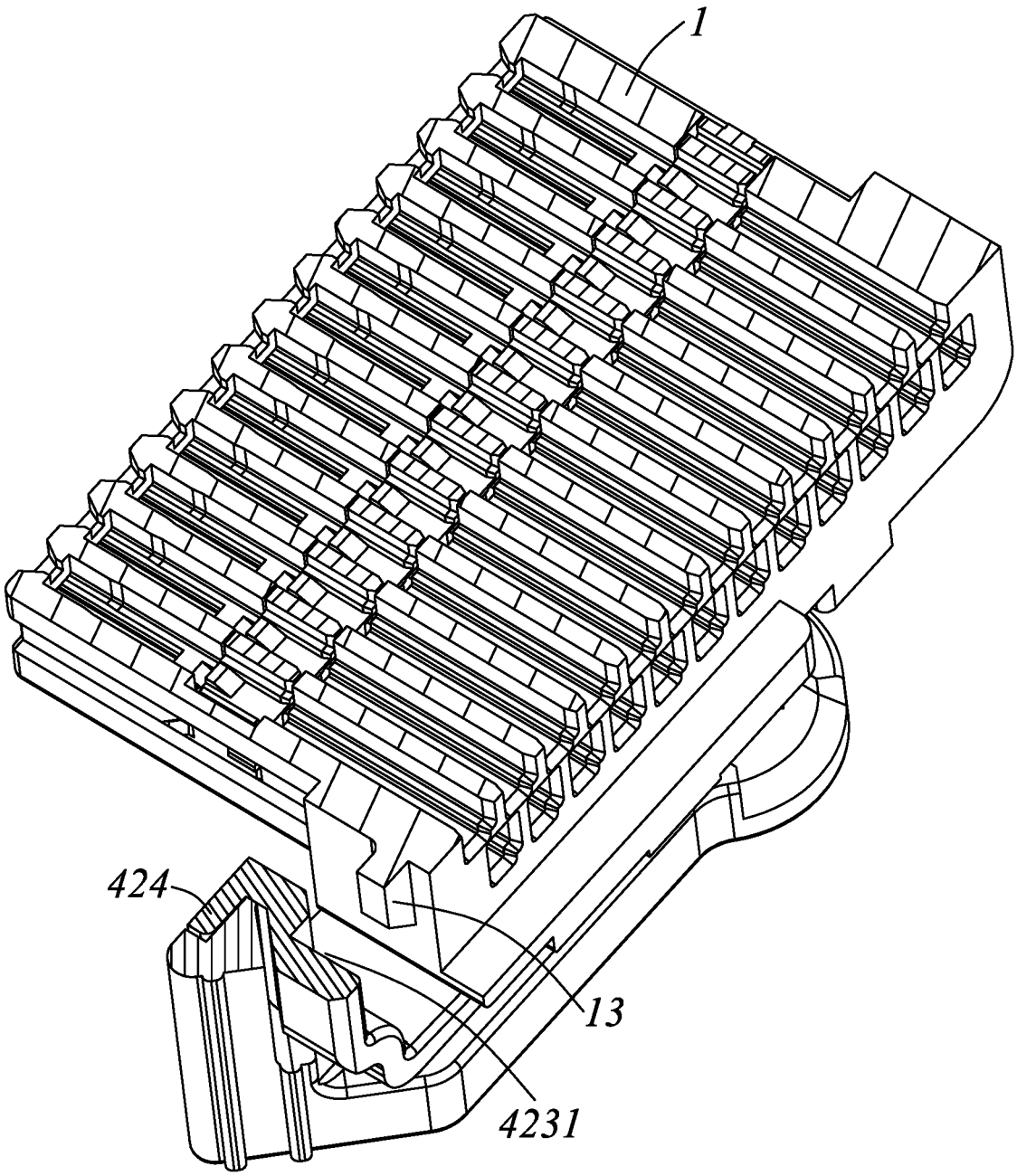
FIGS. 9 to 10 are cross-section views of the electrical connector when contacts and wires removed away shown in FIG. 1.
Figure 10:
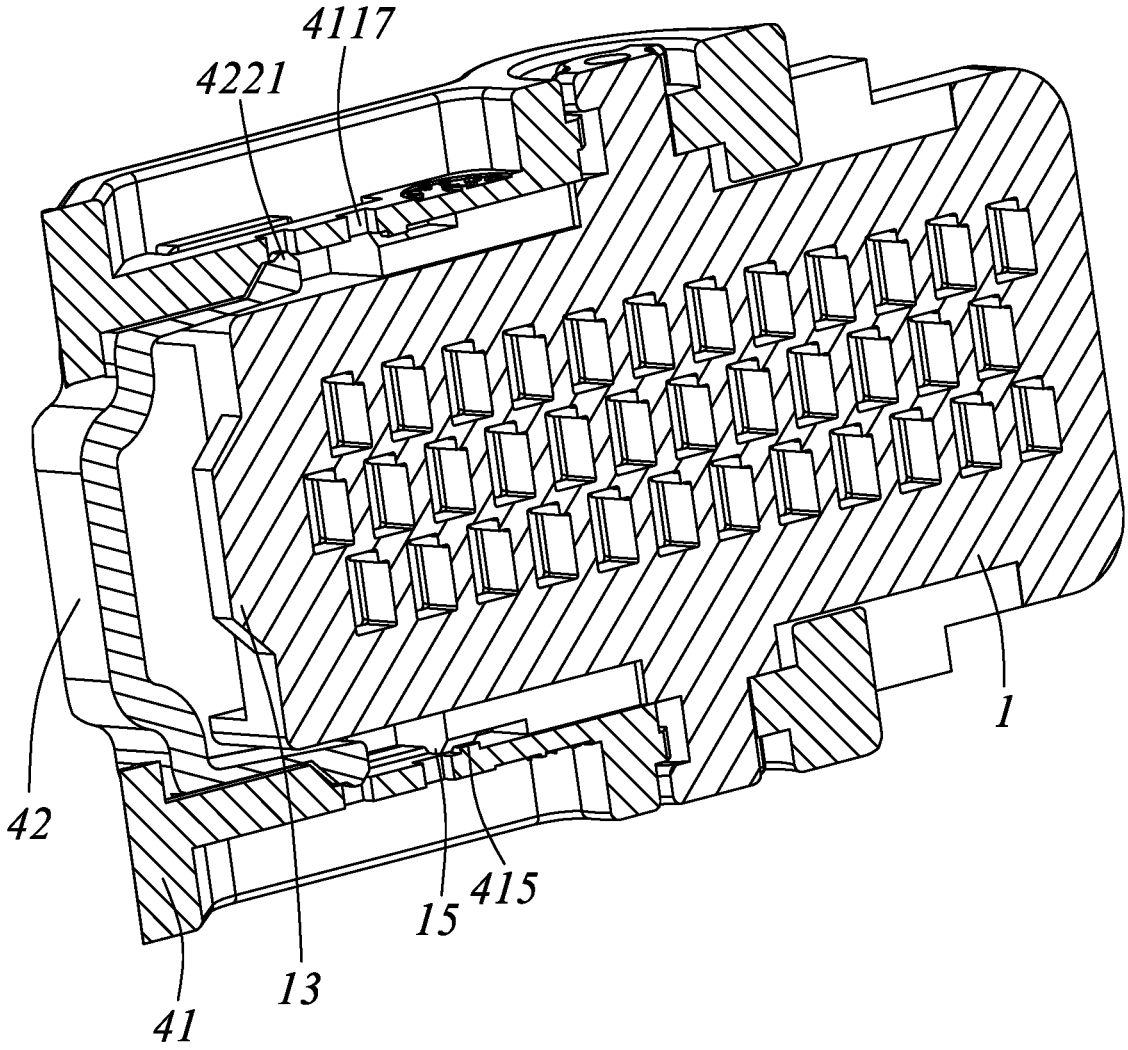
Figure 11:
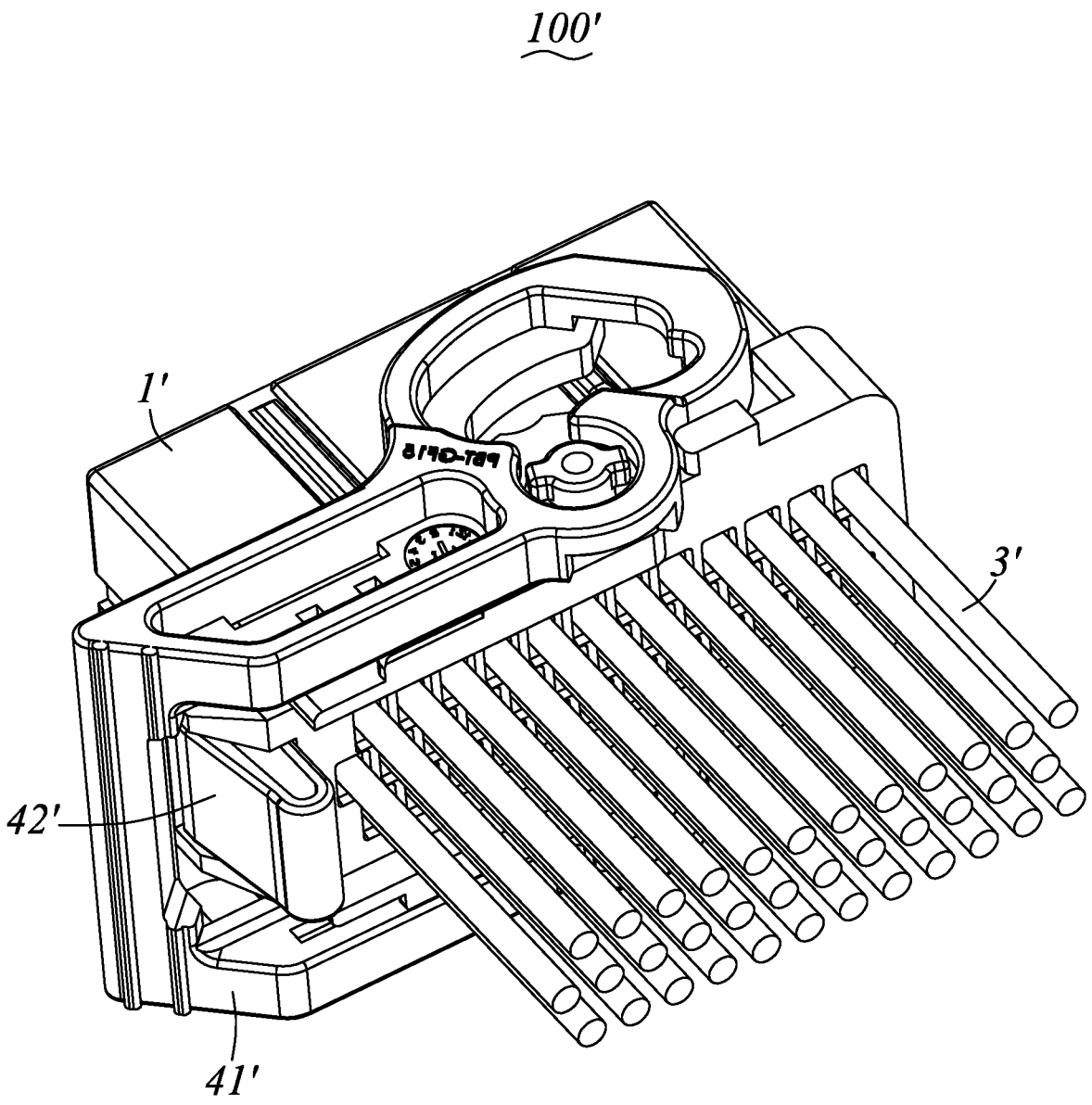
FIG. 11 is a perspective view of an electrical connector according to a second embodiment of the present invention.
Figure 12:
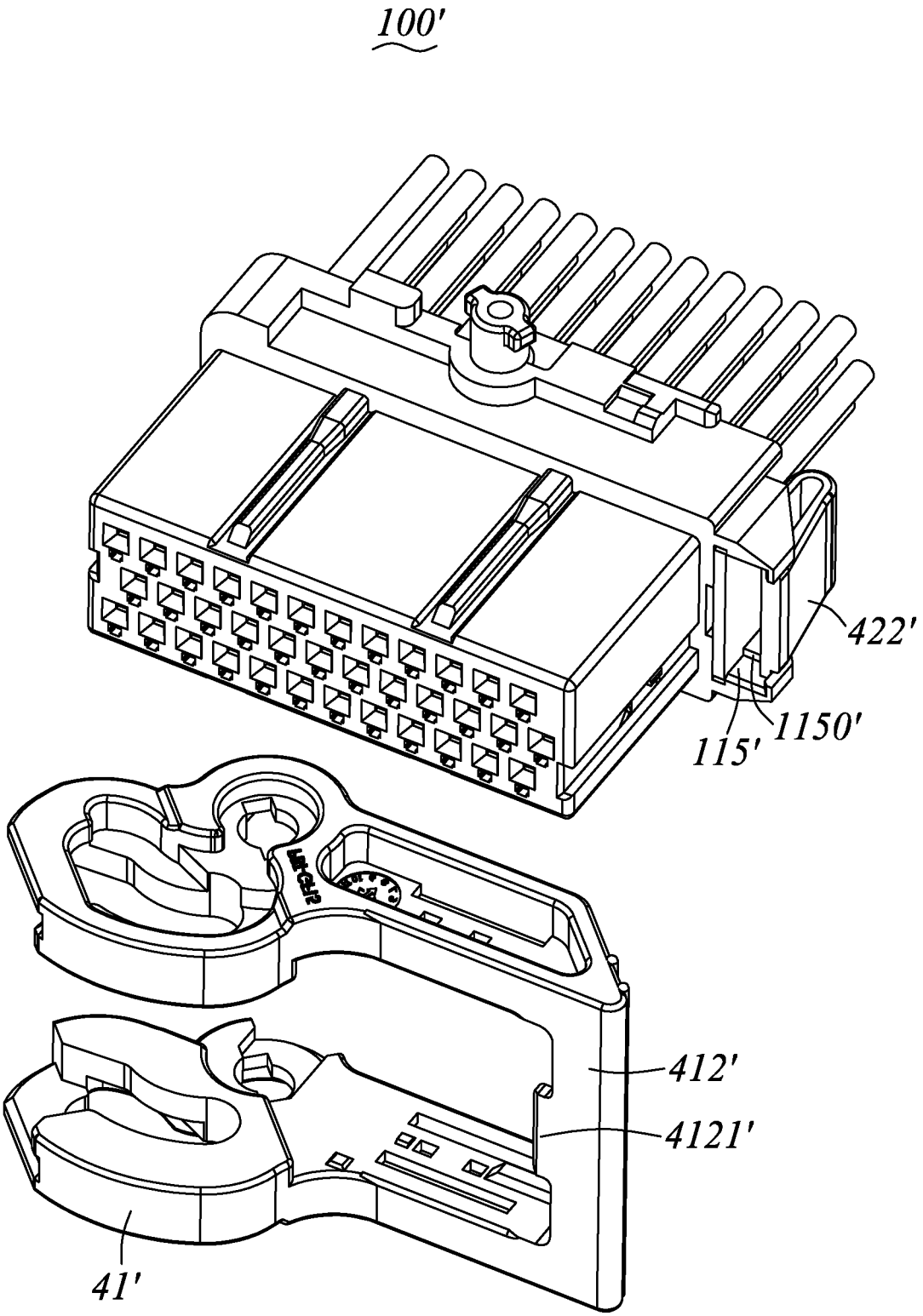
FIG. 12 is a partial exploded view of the electrical connector shown in FIG. 11.

In the first embodiment of the present invention, when the rotating member 41 rotates from the first status to the second status, the fastener 42 moves under the external force along a direction indicated by an arrow shown in FIG. 4, until it is locked with the insulative housing 1, thereby the electrical connector 100 locking with the complementary connector.

Each rotary arm 411 has a first end neighboring to the holding arm 412 and a second end far away from the holding arm 412, the first end is opposite to the second end. A connecting portion 413 rotatably connected with the corresponding pivot 12 and a cam 414 can be locked with the complementary connector are disposed at the second end of each rotary arm 411. The connecting portion 413 defines a pivotal hole 4131 receiving the pivot 12, in the present embodiment, each pivotal hole 4131 is composed of a circular hole in the center and a pair of rectangular holes symmetrically arranged on both sides of the circular hole.

Each cam 414 is provided with an arc sliding channel 4141 and an unlocking chute 4142 communicated with the sliding channel 4141, the unlocking chute 4142 is located on one side of the sliding channel 4141 far away from the first end, thus in the first status of the rotating member 41, the locking mechanism 4 can be locked or unlocked with a latching portion of the complementary connector.

Referring to FIGS. 4 to 8, in the first embodiment of present invention, the fastener 42 is slidably connected with the rotary arm 411, and has a first position and a second position both for locking with the rotary arms 411. When the rotating member 41 rotates to the second status and fastened to the latching portion of the complementary connector, the fastener 42 moves from the first position to the second position under the external force along the direction indicated by the arrow shown in FIG. 4, to make the electrical connector 100 lock with the complementary connector.

Each rotary arm 411 has at least one guiding slot 4116 extending along a length direction thereof, the fastener 42 has at least a sliding portion 421 slidably matching with the guiding slot 4116.

The fastener 42 defines a pair of opposite coupling portions 422 and an operating portion 423 connected with the coupling portions 422. Each coupling portion 422 is fixed to an inner side of the relative rotary arm 411, the sliding portion 421 is disposed on an outer side of the corresponding coupling portion 422. Specifically, a pair of sliding portion 421 are juxtaposed on an exterior surface of each coupling portion 422, and the pair of sliding portion 421 are spaced apart from each other along a width direction of the fastener 42. Each sliding portion 421 is of strip-like shape, and the extension direction of the sliding portion 421 is perpendicular to the width direction of the fastener 42. Each sliding portion 421 extends beyond an end of the relative coupling portion 422 in a direction deviating from the operating portion 423.

Each rotary arm 411 defines two positioning holes 4117 corresponding to the first and second positions respectively, each coupling portion 422 is provided with a fixing portion 4221 protruding on its outer surface, to selectively cooperate with one of the positioning holes 4117.

Each coupling portion 422 further has a concave portion 4222 on its outer surface, and the concave portion 4222 is aligned to the fixing portion 4221 in a direction parallel to the extension direction of the sliding portion 421.

The fastener 42 further has a reinforced wall 424 extruding on one side thereof in the width direction, and the reinforced wall 424 is disposed on an outer side of the operating portion 423 to cooperate with the holding arm 412, thereby preventing the fastener 42 from being separated from the rotating member 41 under a pushing force.

The operating portion 423 further has a limiting groove 4231 on an inner side thereof, while the locking mechanism 4 in the second status, the limiting groove 4231 is opening to the protrusion 13 of the insulative housing 1, and the protrusion 13 is locked into the limiting groove 4231 when the fastener 42 sliding to the second position, thus the fastener 42 is locked in the second status of the fastener 42, thereby realizing a reliable positioning between the locking mechanism 4 and the insulative housing 1.

Each rotary arm 411 further has at least a limiting tab 415 extruding inwards, a joining portion 416 and a stopping portion 417, the limiting tab 415 and the positioning holes 4117 on a same side are arranged along the length direction of the rotary arm 411, and the limiting tab 415 is located on one side of the two positioning holes 4117 close to the second end. When the locking mechanism 4 rotates from the first status to the second status, the limiting tab 415 moves forwardly until it passes through a limiting block 15 defined on an outer side of the insulative housing 1, then the limiting tab 415 is in front of the limiting block 15 and stopped by the limiting block 15, to prevent the locking mechanism 4 from turning to the first status.

Each joining portion 416 is of strip-like shape, and disposed on another side of the two positioning holes 4117 close to the first end, that is to say, the limiting tab 415 and the joining portion 416 are disposed on both sides of the two positioning holes 4117 along the length direction of the rotary arm 411. The joining portions 416 are located in the corresponding concave portion 4222, to further realize a positioning between the rotating member 41 and the fastener 42.

When the locking mechanism 4 in the first status, the stopping portions 417 are abutting against corresponding extrusions (not shown) on upper and lower sides of the insulative housing 1, to ensure the position of the locking mechanism 4 before the electrical connector 100 mating with the complementary connector, and prevent the locking mechanism 4 from turning to the second status before the electrical connector 100 mating with the complementary connector.

At least one stopper 14 is defined on the first side and the second side of the insulative housing 1, a depression 418 is arranged on the second end and on an exterior side of the relative connecting portion 413, and each depression 418 is disposed at a conjunction area between the connecting portion 413 and the cam 414. The stopper 14 is resisted in the depression 418, to prevent the holding arm 412 of the locking mechanism 4 from continuing to rotate forwards.

Figure 2:
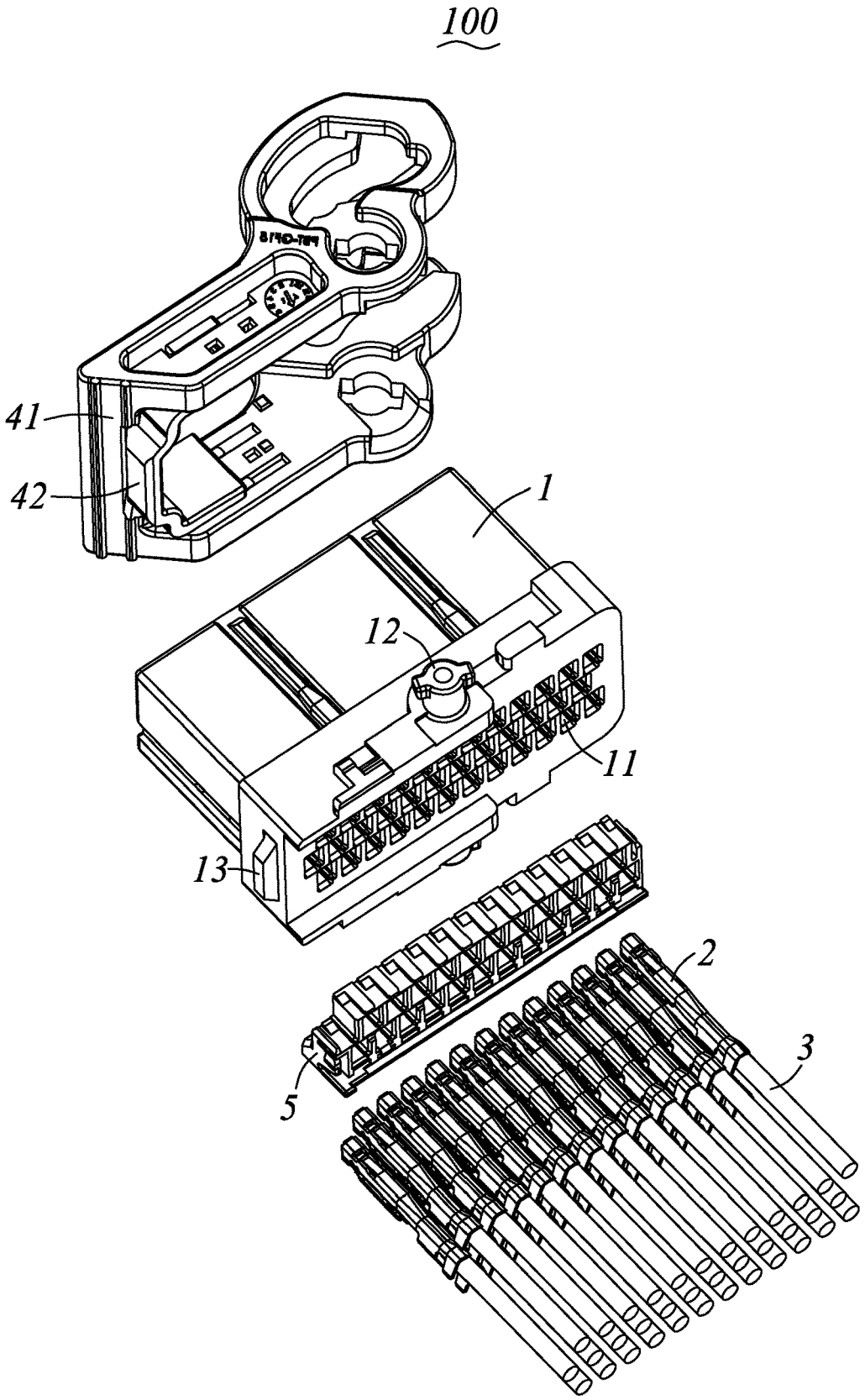
FIG. 2 is an exploded view of the electrical connector shown in FIG. 1.
Figure 3:
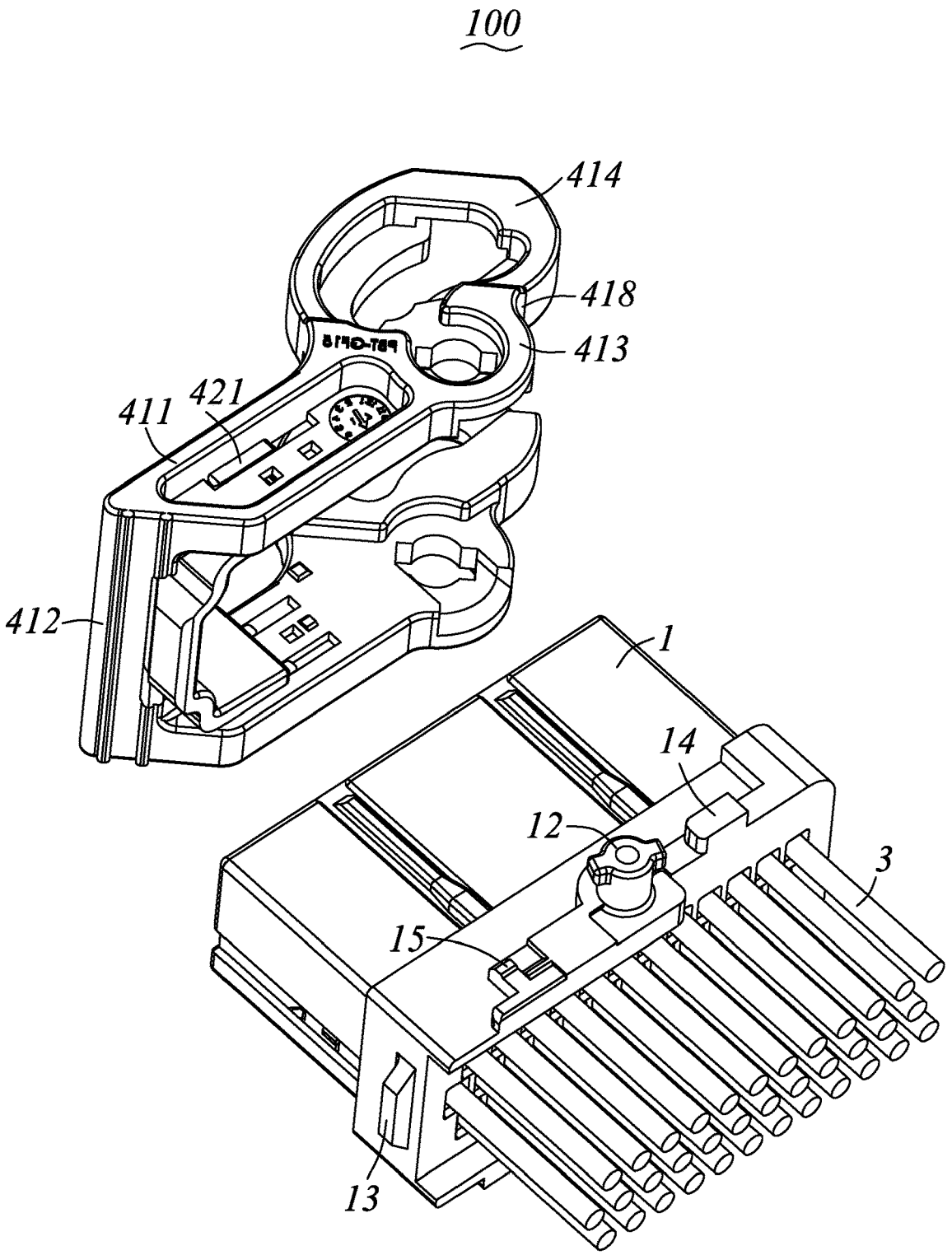
FIG. 3 is a partial assembled view of the electrical connector shown in FIG. 2.

Referring to FIG. 2, the electrical connector 100 further has a retainer 5 assembled to a lower side of the insulative housing 1 to limit the plurality of contacts 2 simultaneously.

Referring to FIGS. 11 to 14, an insulative housing 1', contacts and wires 3' of an electrical connector in the second embodiment of the present invention are similar or same as that of the first embodiment, so the description for them is omitted here for the second embodiment. The difference between the two embodiments is explained as follows.

The insulative housing 1' is provided with a receiving channel 112' opening outwards, and the receiving channel 112' is disposed on one side wall of the insulative housing 1' in a transverse direction thereof. A pair of latching slots 113' are symmetrically arranged on both sides of the receiving channel 112' in a height direction, and a pair of indentations 115' are also symmetrically arranged on both sides of the receiving channel 112' in a height direction. The latching slots 113' and the indentations 115' are communicated with the receiving channel 112', and each latching slot 113' is communicated with the indentation 115' on a same side in present embodiment, in other embodiment, the latching slot 113' cannot be communicated with the indentation 115' on a same side.

Figure 13:
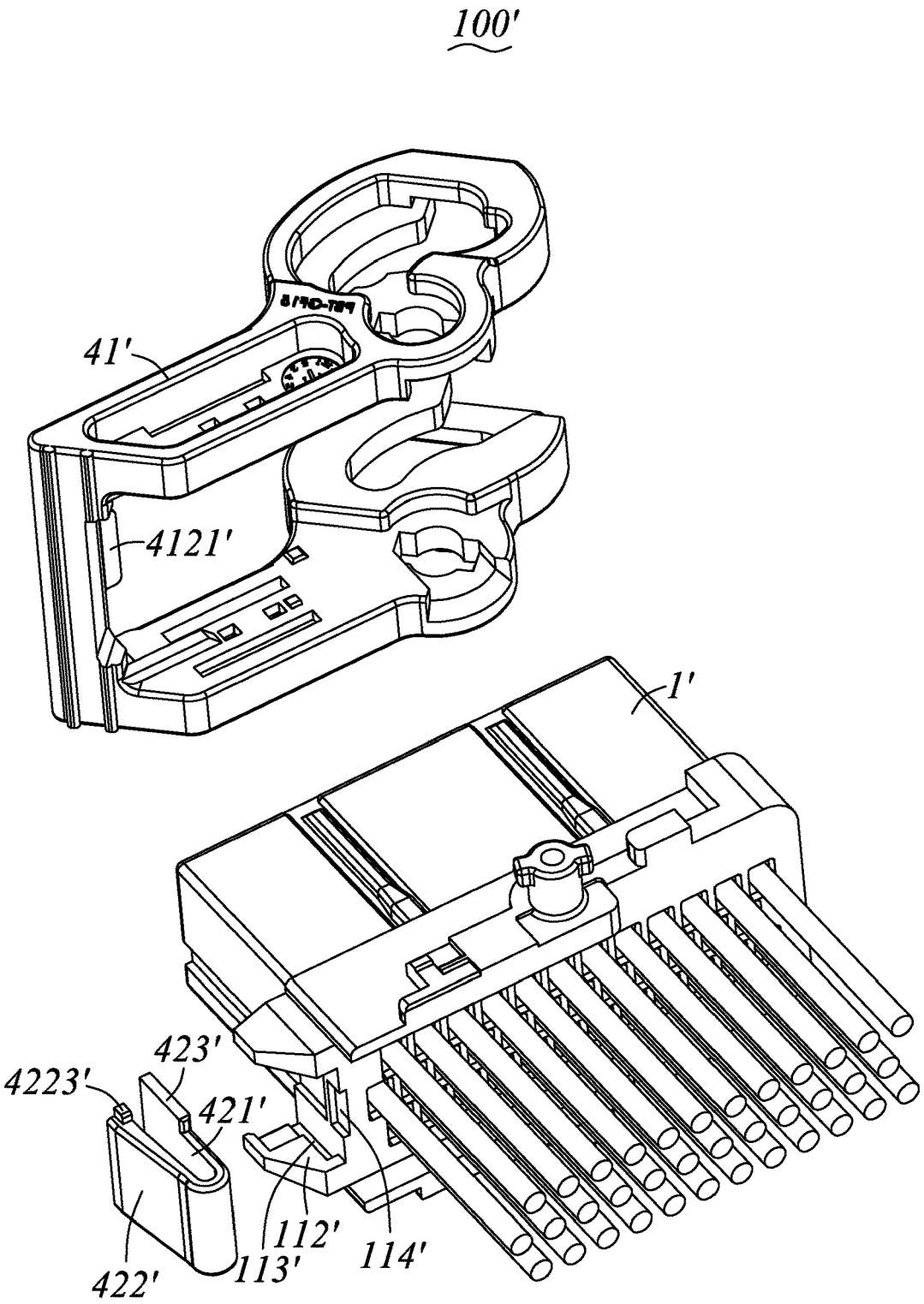
FIG. 13 is a further exploded view of the electrical connector shown in FIG. 12.
Figure 14:
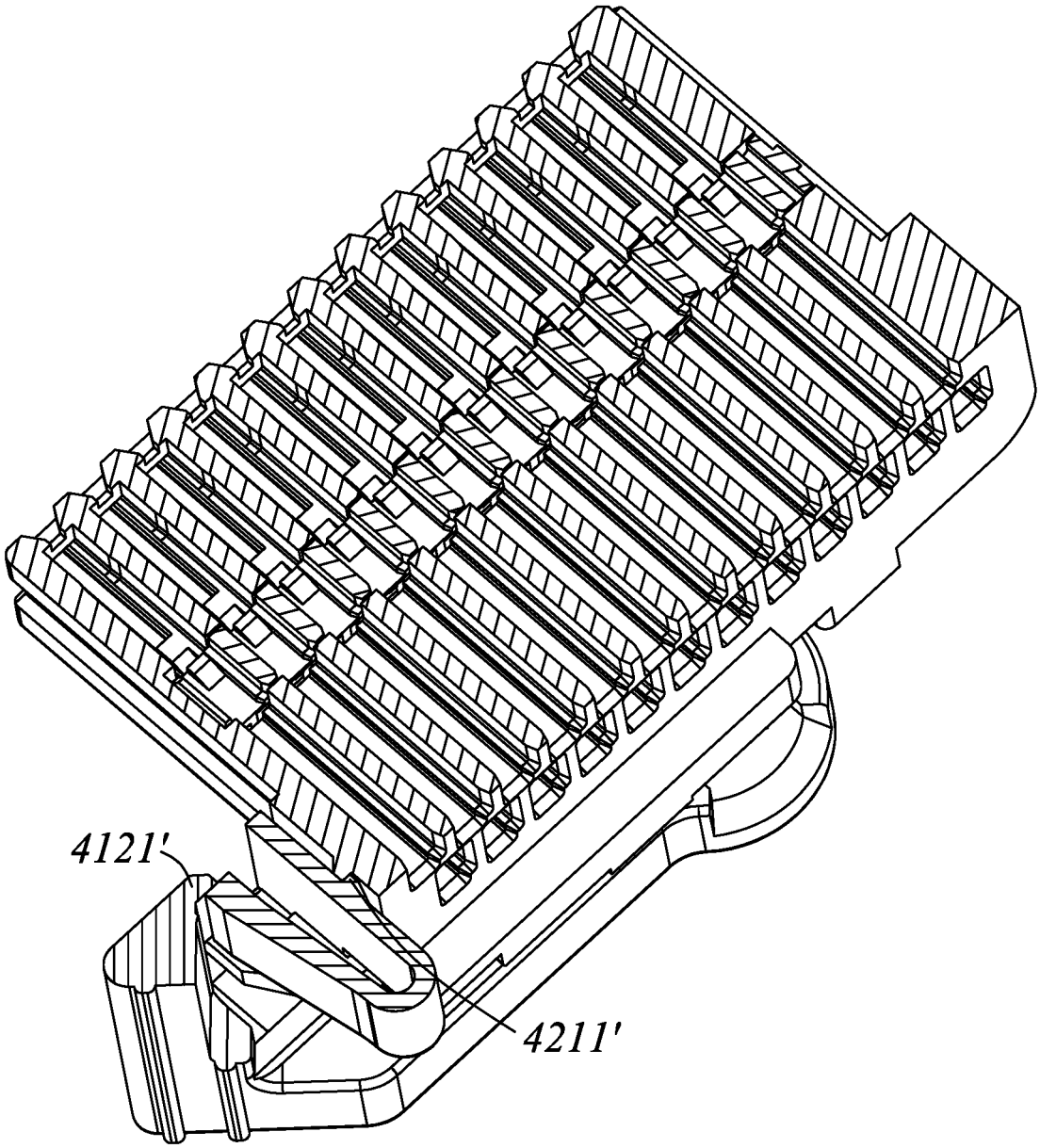
FIG. 14 is a cross-section view of the electrical connector when contacts and wires removed away shown in FIG. 11.

Referring to FIGS. 13 to 14, a catching slot 114' is recessed forwards from a rear end of the side wall, and a holding arm 412' defines an ear portion 4121' protruding inwards, and the ear portion 4121' is formed at a front end of the holding arm 412'.

In the present embodiment, a fastener 42' is assembled into the receiving channel 112', and has a fixing arm 421' connecting with the insulative housing 1' and an elastic arm 422' integrally connected with the fixing arm 421'. A front end of the elastic arm 422' is a free end which takes a rear end of the elastic arm 422' as a fulcrum and elastically moves to realize the lock between the free end and the rotating member 41'.

The fixing arm 421' defines a bump 4211' protruding towards the insulative housing 1' and a pair of mounting portions 423' extruding upwards and downwards along the height direction. The bump 4211' is latched with the catching slot 114', the mounting portions 423' are inserted into the relative latching slots 113' respectively, a pair of lumps 4223' on a front end of the elastic arm 422' elastically slide and is located in the relative indentations 115', each lump 4223' is located in front of a stopping face 1150' which forming the relative indentation 115', and resisted by the stopping face 1150' to prevent the lump 4223' from backing out of the indentation 115'.

In the present embodiment, while the rotating member 41' being rotated to near the second status, the fastener 42' rotates to achieve a locking of the electrical connector 100' and the complementary connector. Specially, after the electrical connector 100' mated with the complementary connector in the first status of the rotating member 41', the rotating member 41' is turned to the second status, the elastic arm 422' of the fastener 42' deflects under the pressure from the holding arm 412', until the holding arm 412' rotates forward to make the ear portion 4121' pass across the elastic arm 422' and latch with the elastic arm 422', and then the rotating member 41' is locked in the second status to realize the electrical connector 100' locking with the complementary connector.

In the present embodiment, the fastener 42' is fixed on a lateral side of the insulative housing 1', the rotating member 41' pushes the elastic arm 422' of the fastener 42' to make it deflect and then lock with the holding arm 412', the elastic rotation of the elastic arm 422' is relatively stable to prevent accidental deviation or even falling caused by improper direct force exertion.

Figure 15:
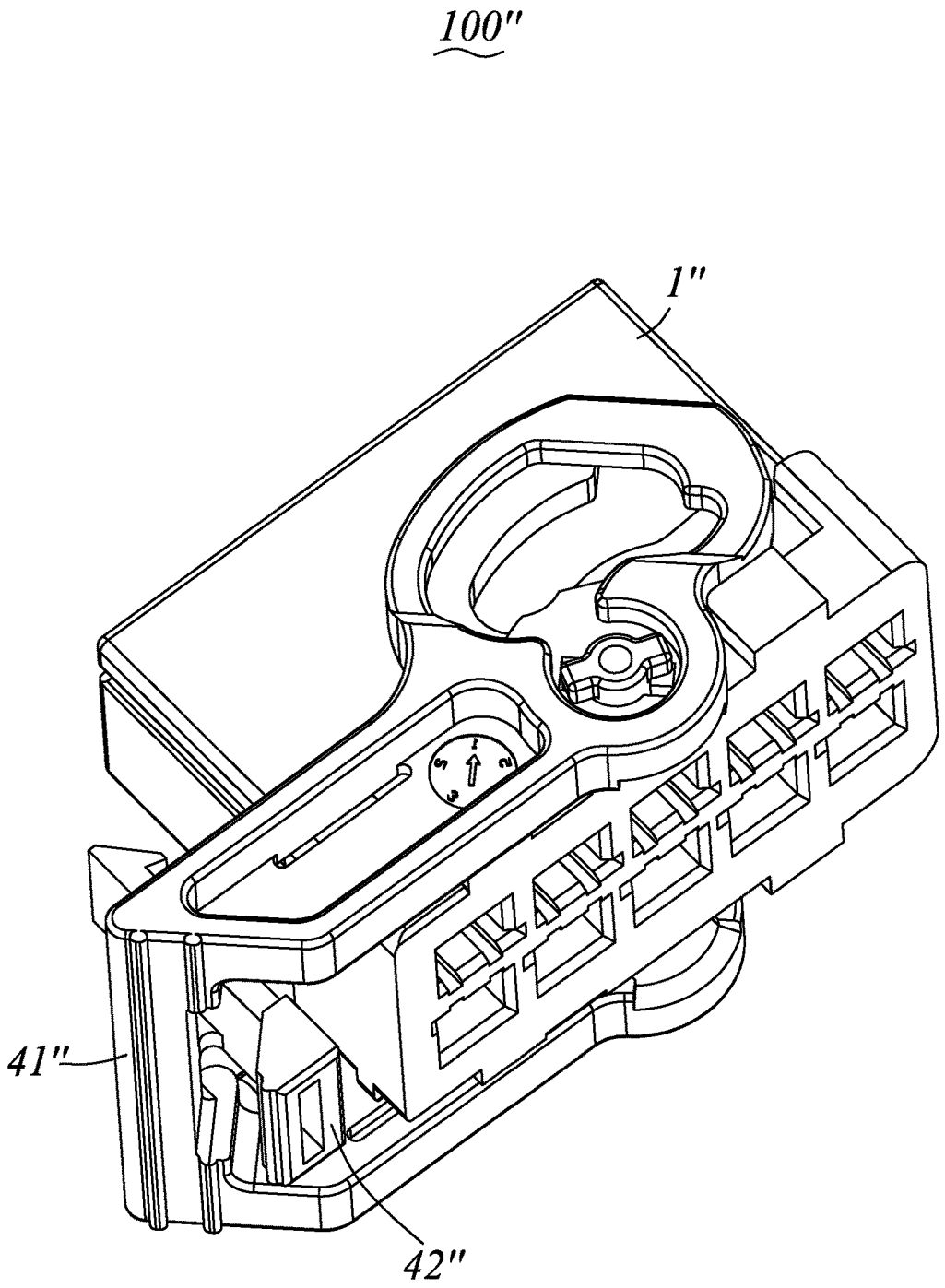
FIG. 15 is a perspective view of an electrical connector according to a third embodiment of the present invention.
Figure 16:
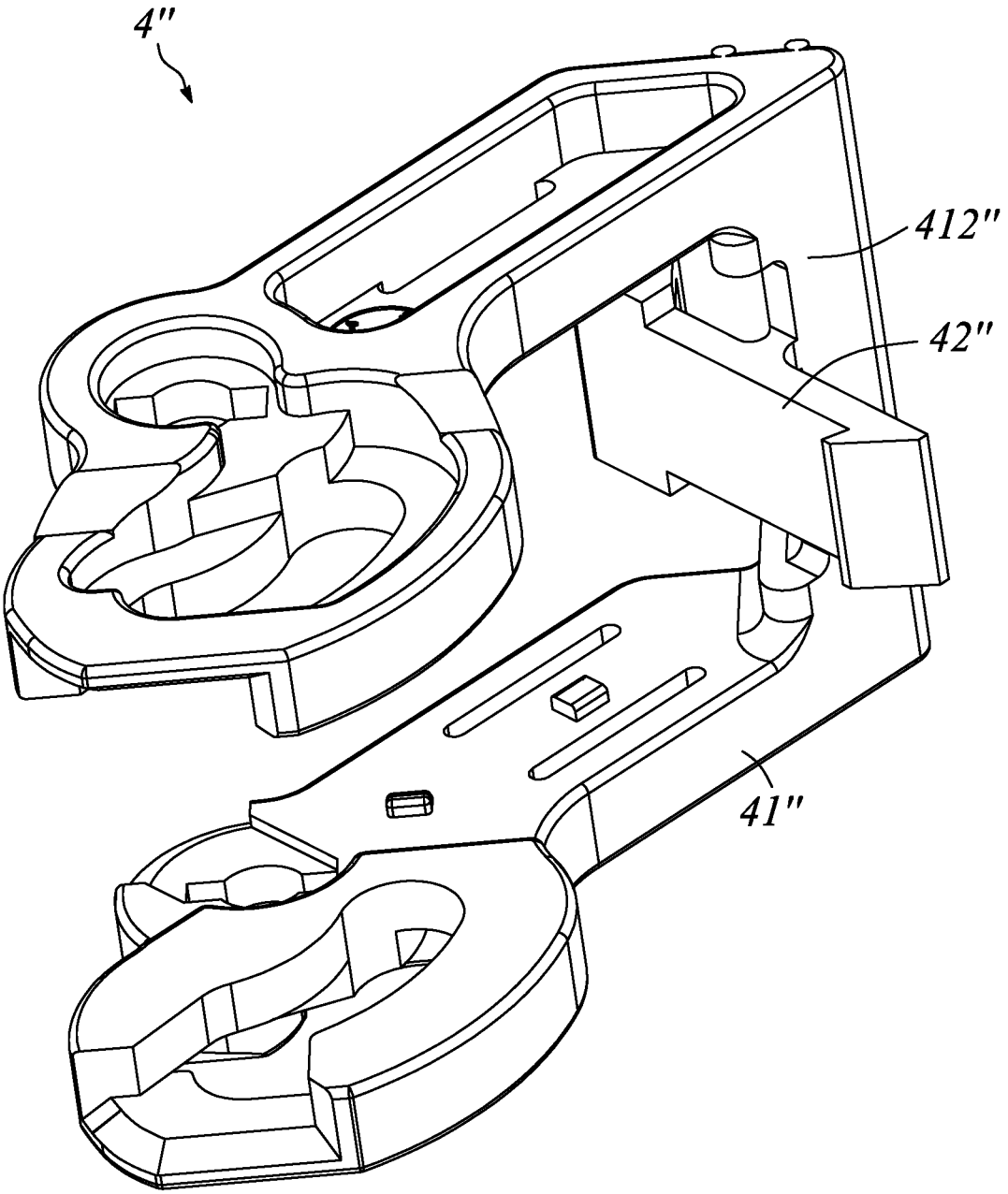
FIG. 16 is a perspective view of a locking mechanism of the electrical connector shown in FIG. 15.
Figure 17:
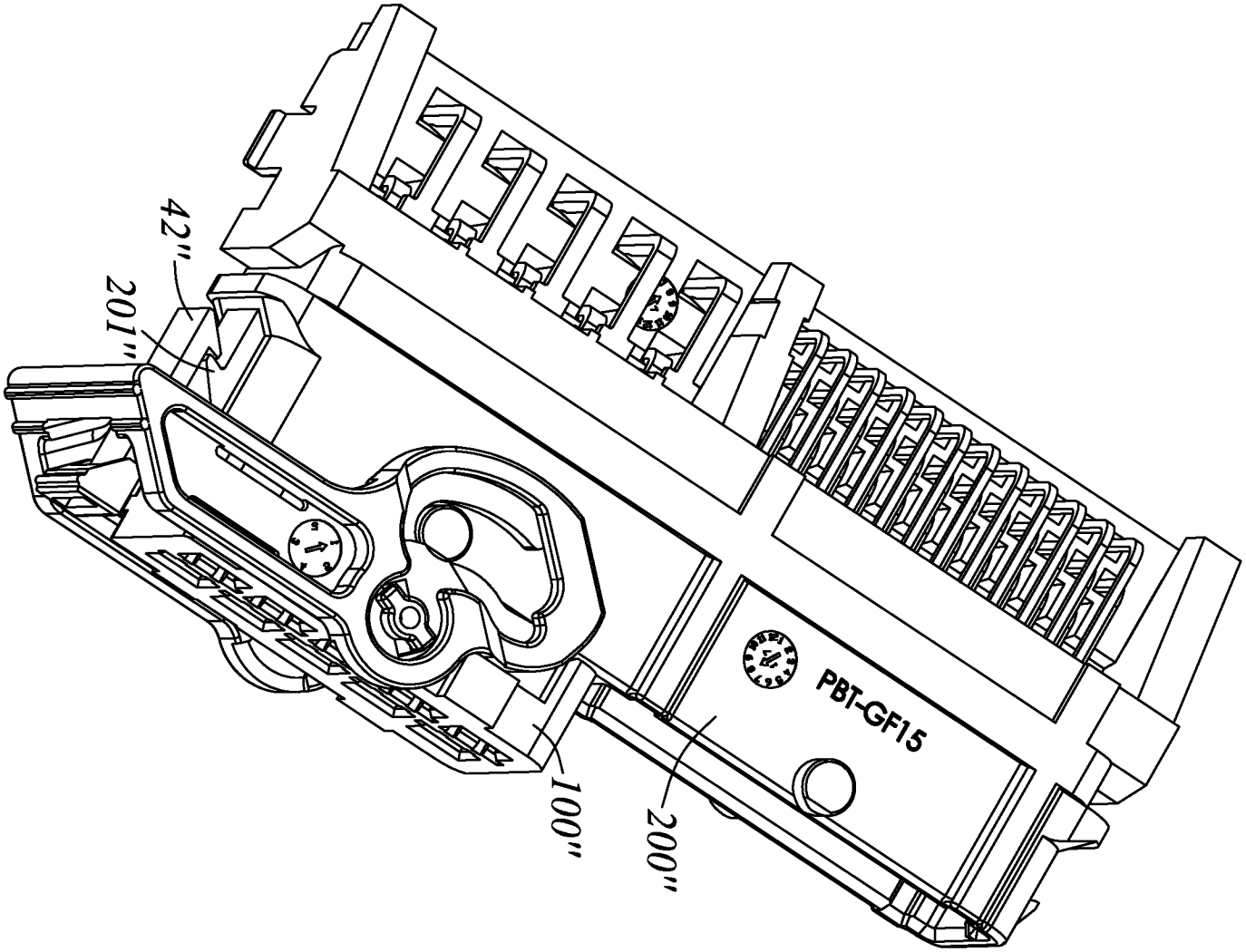
FIG. 17 is a perspective view of the electrical connector plugging and locking with a complementary connector shown in FIG. 15.

Referring to FIGS. 15 to 17, an insulative housing 1", contacts and wires of an electrical connector 100" in the third embodiment of the present invention are similar or same as that of the first embodiment, so the description for them is omitted here for the third embodiment. The difference is as follows: a rotating member 41" and a fastener 42" of a locking mechanism 4" are a one-piece structure, and the fastener 42" is integrally connected with an interior side of a holding arm 412" of the rotating member 41".

While the rotating member 41" being rotated to near the second status, the fastener 42" rotates under the pressure from a locking tab 201" of a complementary connector 200", therefore the electrical connector 100" is locking with the complementary connector 200". Specially, after the electrical connector 100" mated with the complementary connector 200" in the first status of the rotating member 41", the rotating member 41" is turned to the second status, the fastener 42" is pressing against the locking tab 201" of the complementary connector 200" under the pressure from the holding arm 412", the fastener 42" rotates under the reaction force of the locking tab 201" until it is locked with the locking tab 201" of the complementary connector 200", therefore the rotating member 41" is locked in the second status to realize the electrical connector 100" locking with the complementary connector 200".

By means of a hooking between the cams on both sides and the latching portion of the complementary connector, the locking mechanism of the electrical connector can be latched with both sides of the complementary connector in the height direction. Additionally, by means of the rotatable rotating member and the fastener matched with the rotating member, the locking mechanism can be further locked with the insulative housing or the complementary connector on one side in the transverse direction, thereby enhancing the reliability of the electrical connection between the electrical connector and the complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a first side and a second side opposite to each other;

a plurality of contacts retained in the corresponding contact-receiving passageways of the insulative housing;

a plurality of wires mechanically and electrically connected with the contacts; and a locking mechanism for locking the electrical connector with a complementary connector; wherein the locking mechanism comprises a rotating member rotatably connected to the insulative housing and a fastener on an inner side of the rotating member, the rotating member has a pair of opposite rotary arms and an holding arm connected with the two rotary arms, the rotary arms are rotatably connected to the insulative housing, and the fastener is arranged on an inner side of the holding arm, the rotating member has a first status and a second status which can be switched by rotation, while the rotating member in the first status, the electrical connector and the complementary connector can be freely plugged in or separated from each other, and while the rotating member being rotated to near or in the second status, the fastener rotates or shifts to achieve a locking of the electrical connector and the complementary connector.

2. The electrical connector as claimed in claim 1, wherein after the electrical connector mated with the complementary connector in the first status of the rotating member, the rotating member is turned to the second status, the fastener rotates or shifts under the pressure from the holding arm or an external force, until it is locked with at least one of the insulative housing, the rotating member and the complementary connector, therefore the rotating member is locked in the second status to realize the electrical connector locking with the complementary connector.

3. The electrical connector as claimed in claim 1, wherein the insulative housing defines a pair of opposite pivots protruding on the first and second sides, each rotary arm has a first end connected with the holding arm and a second end opposite to the first end, a connecting portion rotatably connected with the corresponding pivot and a cam can be locked with the complementary connector are disposed at the second end of each rotary arm.

4. The electrical connector as claimed in claim 3, wherein each cam is provided with an arc sliding channel and an unlocking chute communicated with the sliding channel, the unlocking chute is located on one side of the sliding channel far away from the first end.

5. The electrical connector as claimed in claim 2, wherein the fastener has a fixing arm connecting with the insulative housing and an elastic arm integrally connected with the fixing arm, and the fastener is fixed on a lateral side of the insulative housing, the rotating member pushes the elastic arm of the fastener to make it deflect and then lock with the holding arm.

6. The electrical connector as claimed in claim 5, wherein a front end of the elastic arm is a free end which takes a rear end of the elastic arm as a fulcrum and elastically moves to realize the lock between the free end and the rotating member.

7. The electrical connector as claimed in claim 6, wherein the holding arm defines an ear portion protruding inwards, and the ear portion is formed at a front end of the holding arm, when the rotating member is turned to the second status, the elastic arm deflects under the pressure from the holding arm, until the holding arm rotates forward to make the ear portion pass across the elastic arm and latch with the elastic arm.

8. The electrical connector as claimed in claim 5, wherein the insulative housing is provided with a receiving channel opening outwards in a transverse direction thereof, and the fastener is assembled into the receiving channel.

9. The electrical connector as claimed in claim 8, wherein the fixing arm defines a pair of mounting portions extruding upwards and downwards along a height direction, the mounting portions are inserted into relative latching slots on opposite sides of the receiving channel respectively.

10. The electrical connector as claimed in claim 9, wherein a pair of indentations are symmetrically arranged on both sides of the receiving channel in a height direction, and a pair of lumps on a front end of the elastic arm elastically slide and is located in the relative indentations.

11. The electrical connector as claimed in claim 10, wherein the fixing arm defines a bump protruding towards the insulative housing, a catching slot is recessed forwards from a rear end of one side wall of the insulative housing, and the bump is latched with the catching slot.

12. The electrical connector as claimed in claim 3, wherein at least one stopper is defined on the first side and the second side of the insulative housing, a depression is arranged on the second end and on an exterior side of the relative connecting portion, and each depression is disposed at a conjunction area between the connecting portion and the cam, the stopper is resisted in the depression, to prevent the holding arm of the locking mechanism from continuing to rotate forwards.

13. The electrical connector as claimed in claim 4, wherein the fastener is slidably connected with the rotary arm, and has a first position and a second position both for locking with the rotary arms, when the rotating member rotates to the second status and fastened to a latching portion of the complementary connector, the fastener moves from the first position to the second position under the external force to make the electrical connector lock with the complementary connector.

14. The electrical connector as claimed in claim 13, wherein each rotary arm has at least one guiding slot, the fastener has at least a sliding portion slidably matching with the guiding slot.

15. The electrical connector as claimed in claim 14, wherein the fastener defines a pair of opposite coupling portions and an operating portion connected with the coupling portions, each coupling portion is fixed to an inner side of the relative rotary arm, the sliding portion is disposed on an outer side of the corresponding coupling portion.

16. The electrical connector as claimed in claim 15, wherein each rotary arm defines two positioning holes corresponding to the first and second positions respectively, each coupling portion is provided with a fixing portion protruding on its outer surface, to selectively cooperate with one of the positioning holes.

17. The electrical connector as claimed in claim 16, wherein each rotary arm further has at least a limiting tab extruding inwards, the limiting tab and the positioning holes on a same side are arranged along a length direction of the rotary arm.

18. The electrical connector as claimed in claim 17, wherein each rotary arm further defines a joining portion, the limiting tab and the joining portion are disposed on both sides of the two positioning holes along the length direction of the rotary arm, each coupling portion has a concave portion on its outer surface for receiving the corresponding joining portions.

19. The electrical connector as claimed in claim 18, wherein the concave portion is aligned to the fixing portion in a direction parallel to the extension direction of the sliding portion.

20. The electrical connector as claimed in claim 18, wherein the limiting tab is located on one side of the two positioning holes close to the second end, and when the locking mechanism rotates from the first status to the second status, the limiting tab moves forwardly until it passes through a limiting block defined on an outer side of the insulative housing, then the limiting tab is in front of the limiting block and stopped by the limiting block.

* * * * *